United States Patent [19]

Bakermans

[11] Patent Number: 5,035,163

[45] Date of Patent: Jul. 30, 1991

[54] PUNCHES AND DIES FOR TRIMMING THE EDGES OF STRIP MATERIAL

[75] Inventor: Johannes C. W. Bakermans, Harrisburg, Pa.

[73] Assignee: AMP Incorporated, Harrisburg, Pa.

[21] Appl. No.: 483,849

[22] Filed: Feb. 23, 1990

[51] Int. Cl.[5] ..... B26F 1/02; B26F 1/12

[52] U.S. Cl. ..... 83/86; 83/213; 83/693; 83/917

[58] Field of Search ..... 83/86, 213, 693, 917, 83/97, 695

[56] References Cited

U.S. PATENT DOCUMENTS

| | | | |
|---|---|---|---|
| 2,064,796 | 12/1936 | Gray | 83/693 |
| 2,279,390 | 4/1942 | Ekstedt et al. | 83/693 |
| 4,497,196 | 2/1985 | Bakermans et al. | 72/405 |
| 4,809,576 | 3/1989 | Bakermans et al. | 83/155 |
| 4,821,615 | 4/1989 | Bakersmans et al. | 83/147 |

FOREIGN PATENT DOCUMENTS

| | | | |
|---|---|---|---|
| 0136237 | 10/1981 | Japan | 83/213 |

*Primary Examiner*—Frank T. Yost
*Assistant Examiner*—John M. Husar

[57] ABSTRACT

Punch and die combinations are disclosed for trimming the edges of strip material. The die openings and the punches have trapezoidal cross-sections so that they form trapezoidal notches in the edge of the strip and produce trapezoidal or, in one instance, parallelogram-shaped, slugs. By virtue of the fact that the die openings and punches have a trapezoidal cross-section, the slugs produced when the edge of the strip is trimmed are pushed into the die openings and passageways extending from the die openings and stacked in an orderly manner so that close packing of the slugs with resulting jamming does not take place.

9 Claims, 6 Drawing Sheets

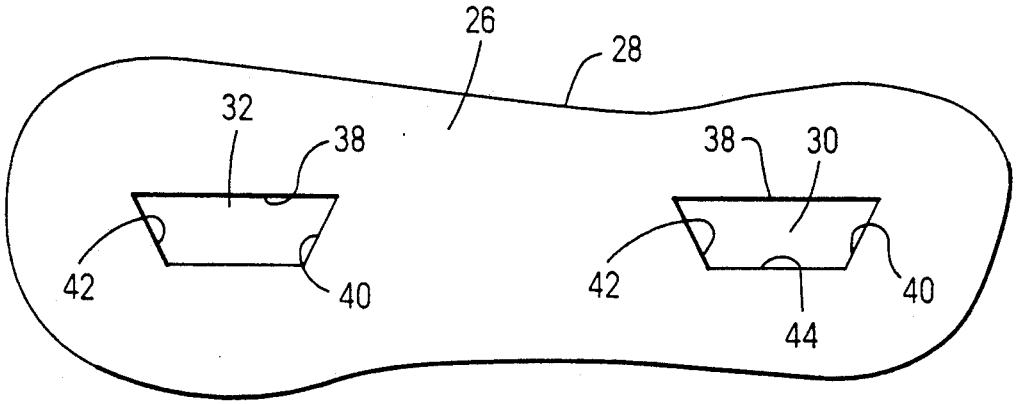
FIG. 4
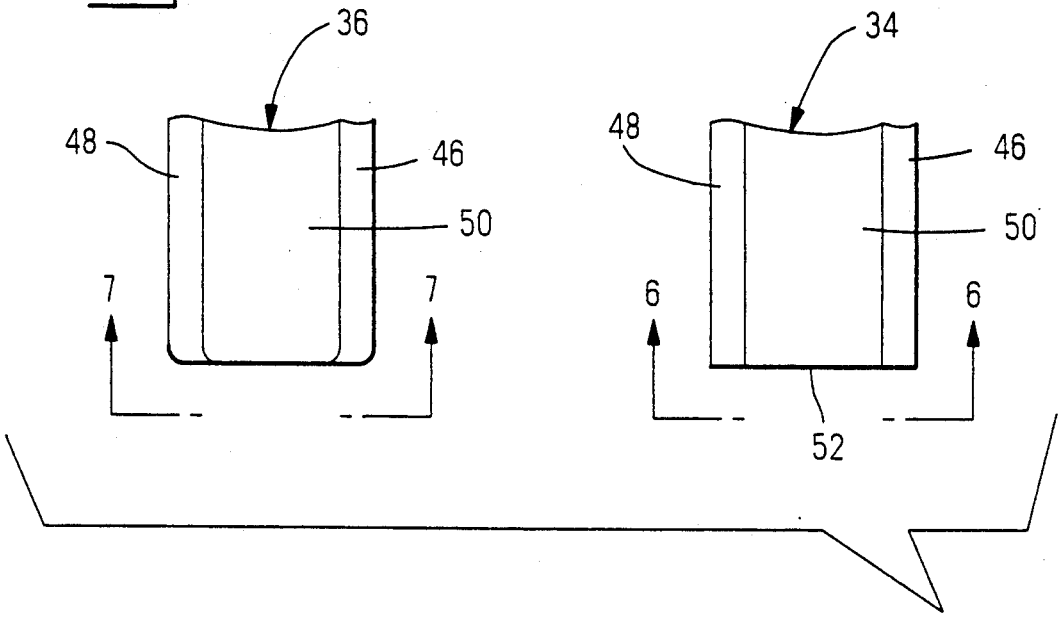
FIG. 5
FIG. 9
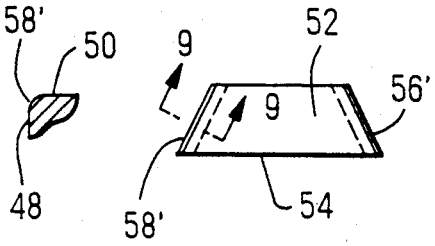
FIG. 8
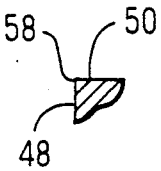
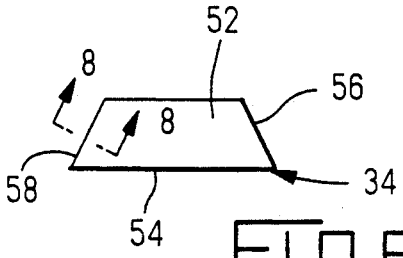
FIG. 6
FIG. 7

PUNCHES AND DIES FOR TRIMMING THE EDGES OF STRIP MATERIAL

FIELD OF THE INVENTION

This invention relates to punches and dies for trimming the edges of strip material during manufacture of articles, such as electrical terminals, from the strip material in a stamping and forming machine.

CROSS-REFERENCES TO ISSUED U.S. PATENTS

U.S. Pat. Nos. 4,497,196, 4,809,576, and 4,821,615 are incorporated by reference into the description presented below.

BACKGROUND OF THE INVENTION

When articles are manufactured from strip material in a stamping and forming machine, it is frequently necessary to trim one or both edges of the strip material. Edge trimming of the strip may be required for the reason that the physical properties of edge portions of the strip (such as elastic modulus and hardness) may be different from the corresponding properties required in the finished articles and which are to be found in central portions of the strip which are spaced from the edge. Also, under some circumstances it is necessary to reduce the width of the strip by an amount required by the dimensions in the finished strip containing the articles. The trimming of the edges is carried out by means of punches and dies which punch slugs from the edges while the strip is intermittently fed past the punches and dies in the stamping and forming machine.

The small pieces of scrap metal, commonly called slugs, which are produced in a stamping and forming machine must be removed from the vicinity of the punches and dies. If the material is relatively thick so that the slugs are heavy, and if the stamping and forming machine is of the conventional type, in which a punch assembly reciprocates vertically towards and away from a fixed die assembly, the relatively heavy slugs will fall through openings in the die assembly and thereby be eliminated by gravity. However, if the material is extremely thin, say 0.008 inches (0.2O mm) or less, the slugs will tend to adhere to each other and to the walls of the passageway into which they are pushed by the punch and become packed in the passageway. The result can be that the passageway will become jammed with compacted slugs and breakage of the punches can occur when the slugs entirely fill the passageway. This problem can be overcome in a conventional stamping and forming machine of the type having a vertically reciprocal punch assembly and a fixed die by the use of a suction system in the passageway through which the slugs pass.

There are disadvantages to the use of suction systems as a means of slug elimination in stamping and forming machines. Such systems require that there be a continuous supply of compressed air and therefore require energy to run the air compressor. The compressed air is exhausted into the room in which the machine is located and are a source of air pollution for the reason that the air from the compressor carries lubricant from the compressor. In a machine of the type shown in U.S. Pat. No. 4,497,196, the fact that the die assembly, as well as the punch assembly, reciprocates makes the provision of the tubing for a suction system difficult.

When the slugs are produced by punching openings which are spaced from the side edges of the strip, the slugs can be eliminated in a machine of the type shown in U.S. Pat. No. 4,497,196 by methods described in U.S. Pat. No. 4,809,576. That patent shows the manner in which slugs can be pushed through a passageway in the die ram block to a cavity through which an endless belt passes. The belt is designed such that it carries the slugs from the end o the passageway in the die block laterally to an external location where they are disposed of. The system described in U.S. Pat. No. 4,809,576 requires, however, that the passageway extends through the die plate and the die ram block closely conform to the shape of the slugs so that the slugs will be maintained in an orderly stack as they are advanced through the passageway by the punch; in other words, during each operating cycle, the punch will punch a slug from the strip material, push it into the die opening, and thereby exert a force on the stack of slugs in the die opening and the passageway so that the stack will move progressively to the cavity and to the belt.

An additional problem is caused by the fact that slugs which are produced in a trimming operation will not always be of the same dimensions for the reason that the width of strip material will vary within some predetermined tolerance limits, usually about ±0.002 inches (±0.051 mm). The die opening and the aligned passageway in the die ram block must be sufficiently large to accommodate the widest slug which may be produced from strip material having some given nominal width and if the passageway and the die opening are so dimensioned, the wide slugs may be eliminated as described above. However, if the strip material is at the lower limit of the tolerance range, the width of the slugs will be somewhat less than the width of the slugs produced from material at the upper limit and the die opening and the passageway will be oversized relative to the width of the slugs. Under these circumstances, the slugs will not necessarily be neatly stacked as required but may become jammed or packed in the die opening or in the passageway as discussed above.

The present invention is directed to the achievement of punch and die combinations with which edge portions of strip material can be trimmed regardless of the width of the strip (within predetermined tolerance limits) without packing or jamming of slugs in the slug receiving die opening and passageway in the die plate and the die ram block.

THE INVENTION

The invention comprises a punch and die combination for trimming one raw edge of a strip of material thereby to produce a trimmed edge. The strip has a center line and the trimmed edge and raw edge are both parallel to the center line, the trimmed edge being spaced from the center line by a distance d and the raw edge being spaced from the center line by a distance d' where d' is greater than d. The strip is intermittently fed along a strip feed path which extends between the punch and die combination when the punch and die are in their open positions. The punch and die combination comprises a die plate having first and second die openings therein which are on the strip feed path, the first die opening being upstream, relative to the direction of strip feed, from the second die opening. First and second punches are provided which conform to the first and second die openings and which enter the first and second die openings when the punches and dies move relatively towards each other from their open position to their closed position. Each die opening has a die opening main shearing edge, the main shearing edges being in alignment with each other and extending parallel to the strip feed path. The main shearing edges are between the raw edge and the center line of the strip and spaced from the center line by the distance d. Each die opening has a die opening upstream shearing edge and a die opening downstream shearing edge. The upstream shearing edge of each die opening extends from the upstream end of the associated main shearing edge laterally outwardly and is inclined in a downstream direction. The downstream shearing edge extends from the downstream end of the associated main shearing edge laterally outwardly and is inclined in an upstream direction. The upstream and downstream die opening shearing edges extend beyond the raw edge of the strip. Each of the punches has a punch main shearing edge which is opposed to, and cooperable with, the associated die opening main shearing edge. The first punch has upstream and downstream punch shearing edges extending from the upstream and downstream ends of the first punch main shearing edge. These upstream and downstream punch shearing edges are opposed to, and cooperable with, the upstream and downstream die opening shearing edges of the first die opening. The second punch has upstream and downstream non-shearing rounded edges extending from the upstream and downstream ends of the second punch main shearing edge which are opposed to the upstream and downstream shearing edges of the second die opening. During intermittent feeding of the strip material along the strip feed path and movement of the punch and die combination relatively towards and away from each other during non-feeding intervals, spaced apart notches will be punched from the raw edge by the first punch and first die opening and the material between the notches will be removed by the second punch and second die opening. Any portions of the strip material which extend beyond the upstream and downstream shearing edges of the second die opening will be pulled into the second die opening by the rounded edges of the second punch. These slugs will be trapezoidal in shape and will be stacked in the second die opening. The strip has a pitch p and is fed during each operating cycle by a distance equal to $2p$. The second punch and die opening are spaced from the first punch and die opening by a distance of at least $3p$.

In accordance with an alternative embodiment, a third die opening and a third punch are provided. The third punch and third die opening are between the first punch and first die opening and the second punch and the second die opening. The third die opening may be substantially identical to the first and second die openings. The third punch has a main shearing edge and an upstream laterally extending shearing edge which is identical to the upstream laterally extending shearing edge of the first punch. The third punch has a rounded non-shearing downstream edge which extends outwardly and is inclined in an upstream direction whereby the slug punched from the strip by the third punch will be in the shape of a parallelogram. Any portions of the slug punched by the third punch which extend beyond the downstream non-shearing edge of the third die opening will be pulled into the third die opening and stacked therein.

When a third die opening and third punch are provided, the strip has a pitch p and is fed during each feeding cycle by a distance $3p$. The third punch and third die opening are spaced from the first punch and first die opening by a distance of at least $2p$ and the second punch and second die opening are spaced from the third punch and third die opening by a distance of at least $2p$.

THE DRAWING FIGURES

FIG. 4 is a fragmentary plan view of a portion of a die plate showing the die openings used in the practice of the invention.

FIG. 5 is a view showing the punches which cooperate with the die openings of FIG. 4.

FIGS. 6 and 7 are views looking in the direction of the arrows 6–6 and 7–7 in FIG. 5.

FIGS. 8 and 9 are views looking in the direction of the arrows 8–8 and 9–9 of FIGS. 6 and 7 respectively.

Figure 10:
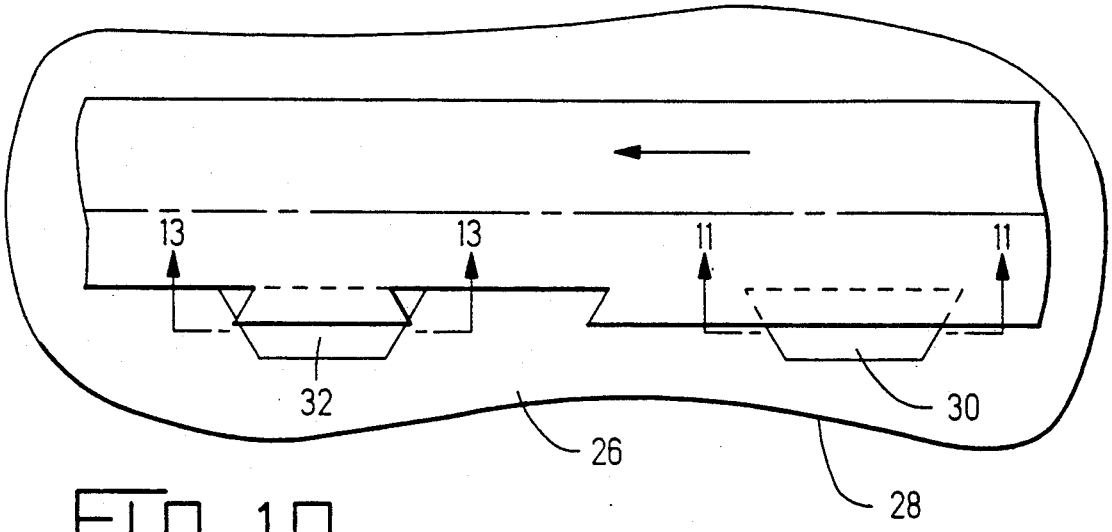

FIG. 10 is a view similar to FIG. 4 but showing the strip positioned on the surface of the die plate and over the die openings.

Figure 11:
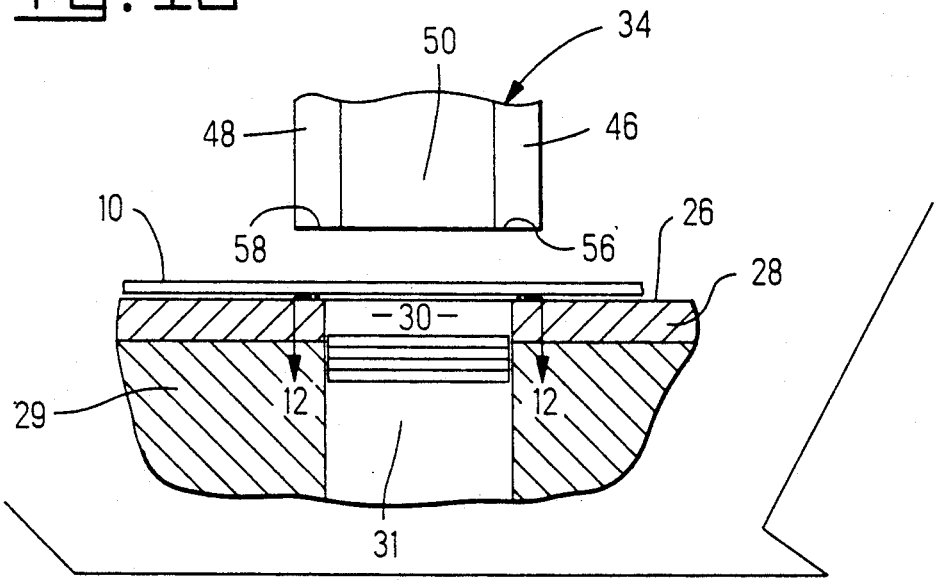

FIG. 11 is a view looking in the direction of the arrows 11–11 of FIG. 10.

Figure 12:
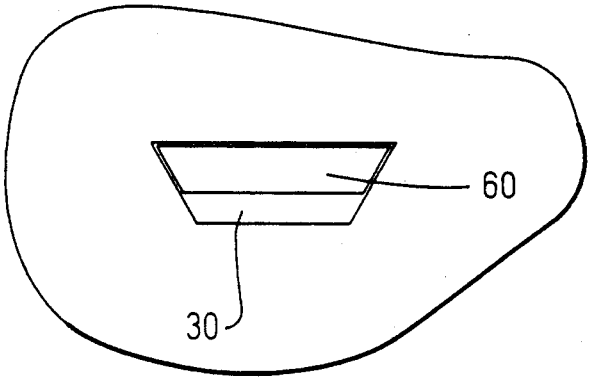

FIG. 12 is a view looking in the direction of the arrows 12–12 of FIG. 11.

Figure 13:
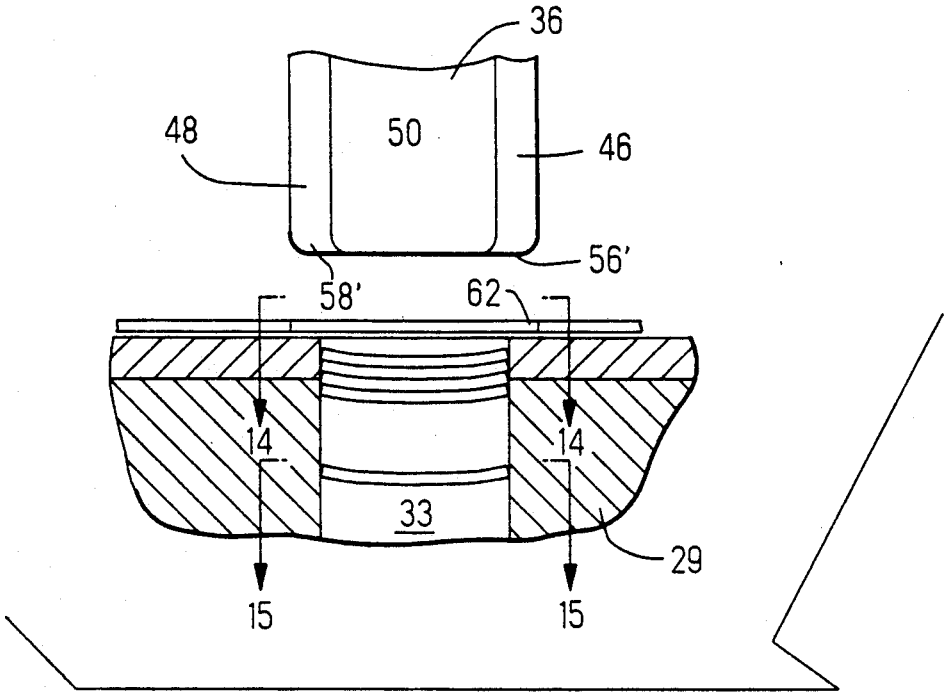

FIG. 13 is a view looking in the direction of the arrows 13–13 of FIG. 10.

Figure 14:
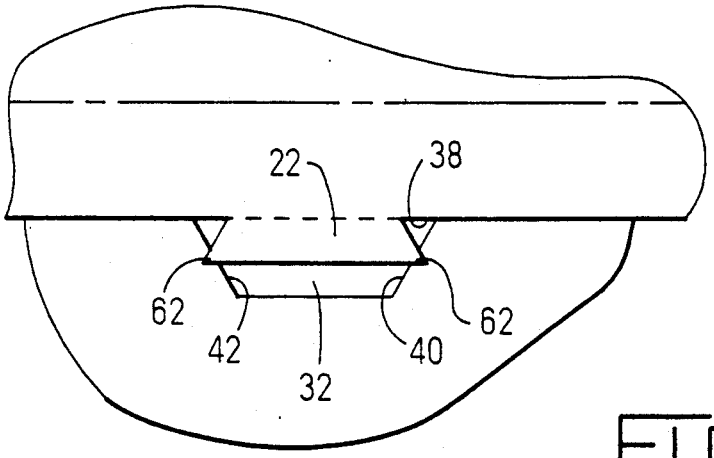
Figure 15:
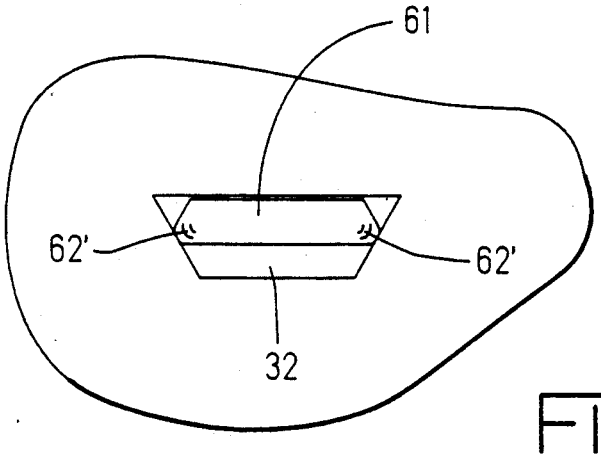

FIGS. 14 and 15 are views looking in the direction of the arrows 14–14 and 15–15 of FIG. 13.

Figure 16:
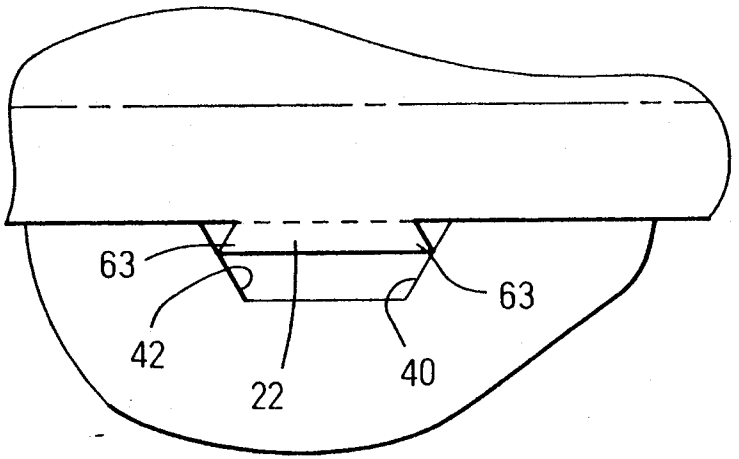

FIG. 16 is a view similar to FIG. 14 but showing the positions of the strip when the strip is of minimum width within the dimensional tolerance of the strip.

Figure 17:
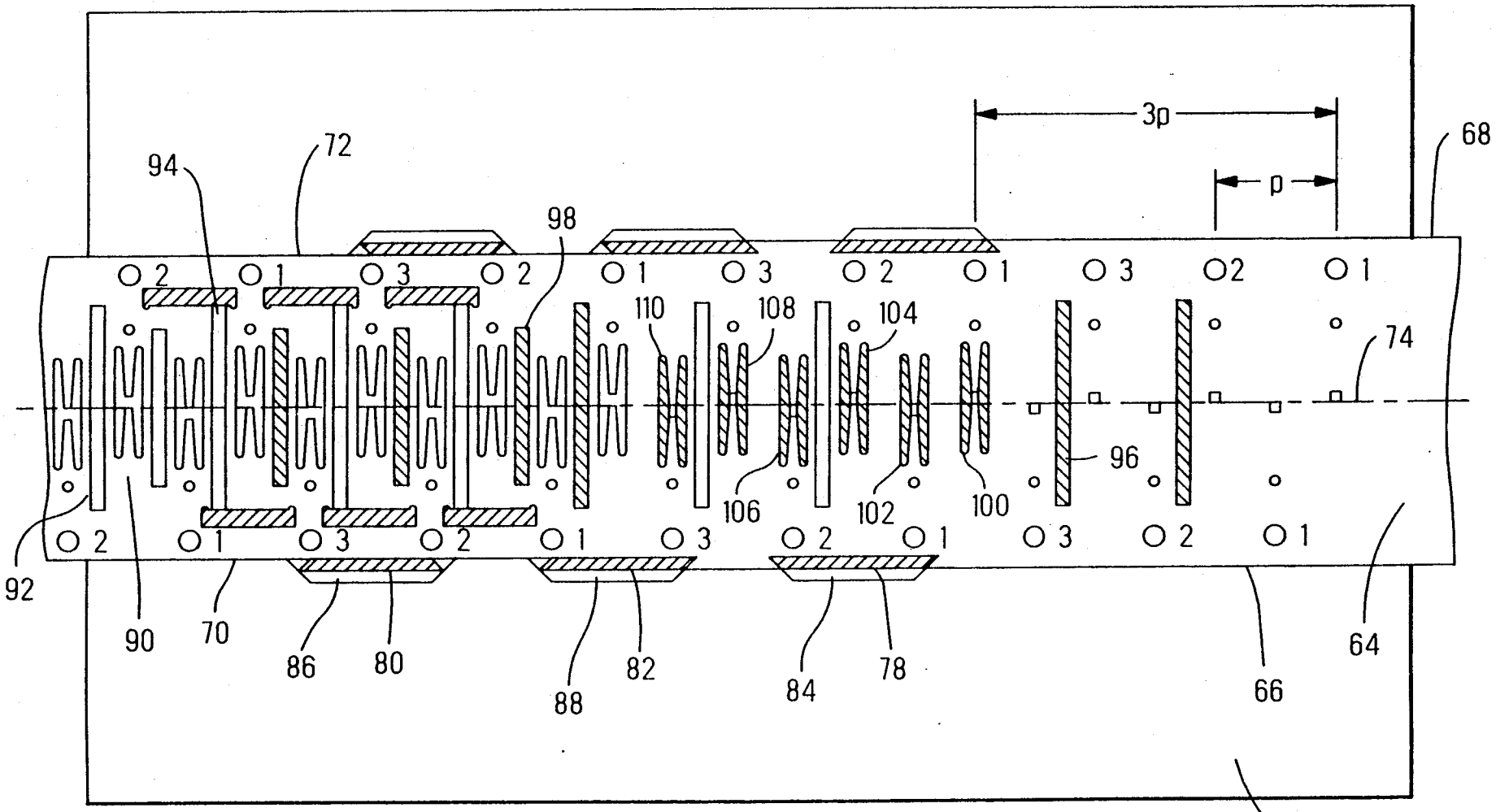

FIG. 17 is a plan view of an alternative embodiment showing, in addition to the edge trimming dies, the position of punches for turning out blanks for small articles.

Figure 18:
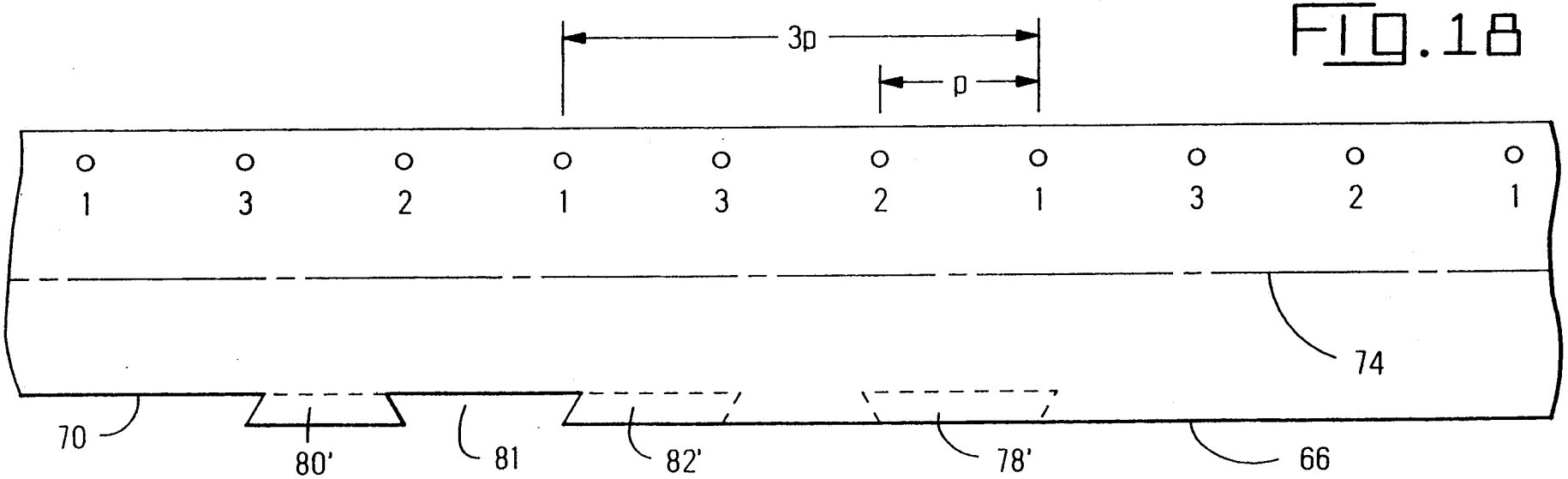

FIG. 18 is a fragmentary view which shows the progression of the strip of FIG. 17 insofar as it relates to the trimming operation.

THE DISCLOSED EMBODIMENT

Figure 1:
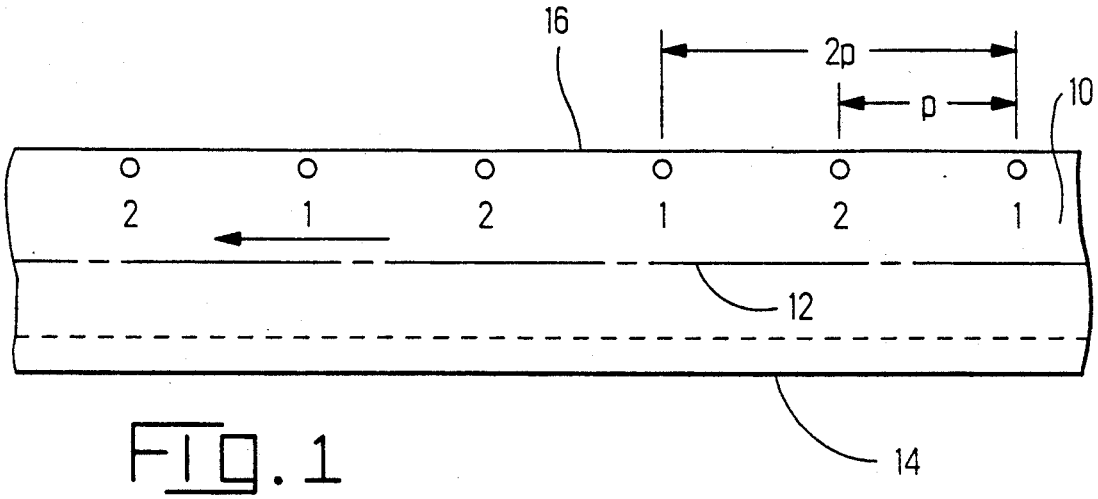
FIGS. 1–3 show the punching operations which are carried out on a strip of material during an edge trimming operation, in accordance with the invention.
Figure 2:
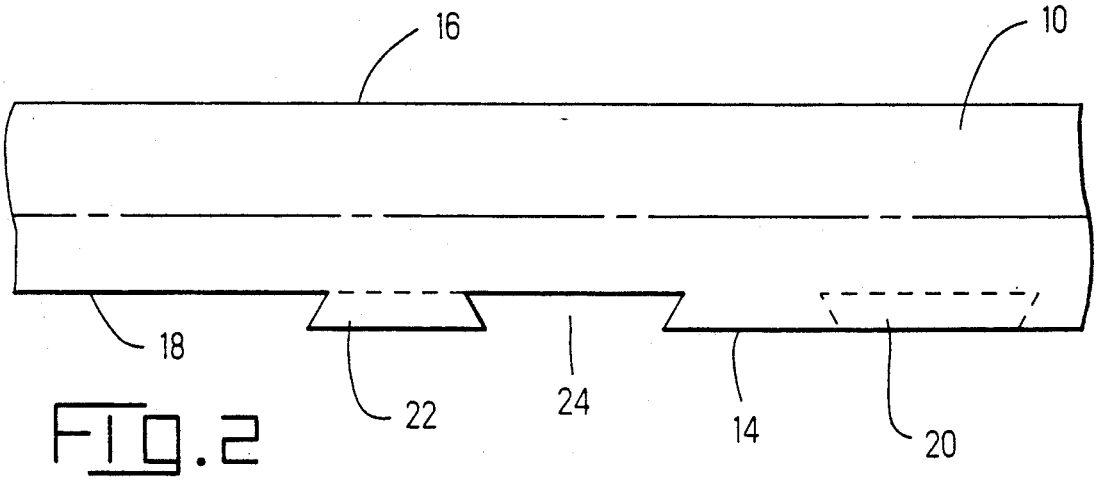
Figure 3:
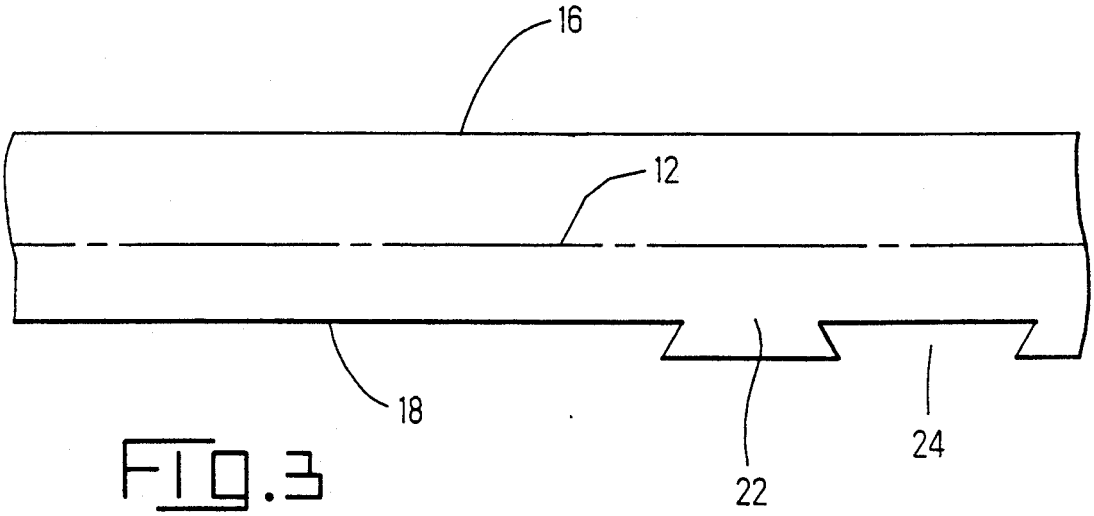

FIG. 1 shows a strip of material 10 having raw (untrimmed) side edges 14, 16, and a center line 12. FIGS. 2 and 3 show the successive steps required to produce a trimmed side edge 18 as the strip is intermittently fed through a punch and die combination in accordance with the invention. The strip has a pitch p shown in FIG. 1 and is fed during each feeding cycle by a distance $2p$. The pitch and feed length are indicated by pilot holes numbered alternately 1 and 2 and which are spaced apart by a single pitch.

FIG. 2 shows a progression of the strip insofar as the edge trimming operation is concerned. This figure assumes that the strip has been fed after a punching operation and that the subsequent punching operation has not yet been carried out. FIG. 3 shows the strip after the subsequent punching operation has been performed and prior to feeding of the strip. In FIG. 2, the strip has a trimmed edge 18 which extends leftwardly from a trapezoidal projecting ear 22. Adjacent to the ear is a trapezoidal notch 24 and the raw edge 14 extends rightwardly from this notch. During the punching operation, the ear 22 is sheared from the edge of the strip so that the trimmed edge will extend rightwardly to the notch 24. In the same punching cycle, a new trapezoidal notch is produced in the raw edge by punching out the material enclosed at 20 by the broken line in FIG. 2. After the punching operation has been performed, the lower edge of the strip will have a new projecting ear 22 and a new adjacent notch 24 so that when the strip is fed by a distance of *2p*, the ear and notch 22, 24 of FIG. 3 will be located in the positions of the ear and notch of FIG. 2.

FIGS. 4 and 5 show the die opening and punches which carry out the operations described and shown in FIGS. 2 and 3. The die plate 28 will normally be mounted on a die backup block or die ram block 29 (FIG. 13) as described in the above-identified U.S. Pat. No. 4,809,576. Die openings 30, 32 extend inwardly from the surface 26 of the die plate and are in alignment with passageways 31 in the die backup plate or backup ram 29. The die opening 30 receives a punch 34 and the die opening 32 receives a punch 36. The die opening 30 has a die opening main shearing edge 38 which extends parallel to the direction of strip feed, an upstream die opening shearing edge 40, and a downstream die opening shearing edge 42. The upstream edge 40 extends laterally from the upstream end of the main shearing edge 38 outwardly beyond the raw edge of the strip as shown in FIG. 10 and is inclined in a downstream direction. The downstream shearing edge 42 extends laterally outwardly from the downstream end of main shearing edge 38 and is inclined in an upstream direction. The edge 44 of the opening 30 does not perform any shearing operations.

The punch 34 has side surfaces 46, 48, and 50 which extend to the lower surface 52 at the free end of the punch. The cross-section of the punch conforms to the cross-section of the die opening 30. The punch has a punch main shearing edge 54 and upstream and downstream punch shearing edges 56, 58. As shown in FIG. 8, the upstream and downstream edges are sharp edges which cooperate with similarly sharp edges 40, 42 in the die opening 30 to punch out the trapezoidal-shaped slug 60 (FIG. 12) that produces the notch 24 in the strip.

The die opening 32 is similar and in fact can be identical to, the die opening 30. The punch 36 has a main shearing edge 54 but differs from the punch 34 in that the upstream and downstream edges 56', 58' are rounded as shown in FIG. 9 and do not perform a shearing function. These edges are rounded so that they will function to pull portions of the slug 61' (FIG. 15), produced when the ear 22 is severed from the strip, into the die opening as shown in FIGS. 13 and 15.

The slugs 60 produced by the punch 34 and die opening 30 are trapezoidal as shown at 60 in FIG. 12 and conform closely to the die opening 30 in the die plate 28. These slugs will therefore be stacked in an orderly stack in the die opening and in the passageway 31 and will be pushed through the passageway to the disposing belt as described in the above-identified U.S. Pat. No. 4,809,576. Even though the slugs have a width which is less than the width of the die opening 30, the slugs 60 cannot move towards the narrow side of the die opening for the reason that the slugs and the die opening are trapezoidal in cross-section.

The slugs 60 which are produced when the notch 24 is formed by the punch 34 and die opening 30 will always be as shown in FIG. 12 regardless of whether the strip has a width which is at the upper or lower limit of its tolerance range. If the strip is relatively wide, that is, if the strip has a width which is at the upper limit of its tolerance range, the slugs produced will be slightly wider than slugs produced from strip which is at the lower limit of the tolerance range. In all cases, the slugs will be closely confined in the die opening 30 and the passageway 31 because of the fact that the trapezoidal slugs conform to the die opening and the passageway as shown in FIG. 12.

The slugs 61 which are produced when the ear 22 is severed from the strip by punch 36 and die opening 32 do not conform to the die opening for the reason that the slugs, while they are trapezoidal like the die opening, are reversed as shown in FIG. 14. The actual width of the strip affects the manner in which these slugs 61 are managed as will now be described.

As shown in FIG. 14, the projecting ear 22 has corners 62 which extend beyond the upstream and downstream edges 40, 42 of the die opening 32. Also, it should be noted that the length of the ear, as measured in the direction of strip feed, is considerably less than the length of the shearing edge 38 of the die opening 32. When the ear 22 is severed from the strip to produce the slug 61, the projecting corner portions 62 of the resulting slug will be pulled downwardly as viewed in FIG. 13 and pushed into the die opening 32. These corners will curl somewhat as shown at 62' and the slug will thereby be jammed into the die opening 32 and the slugs from previous operations and the newly formed slug will thereby be stacked in an orderly manner in the passageway 33 as shown in FIG. 13. Close control is thus maintained over the slugs 61 notwithstanding the fact that the surface area of each slug is considerably less than that of the die opening and the individual slugs 61 contact the sides of the die opening and the passageway only at the curled corners 62 and along the sheared edge.

The foregoing description assumes that the strip material 10 has a width which is at the upper limit of its tolerance range which, as noted above, can be as much as ±0.002 inches (±0.051 mm). When the strip is at the upper limit of its tolerance range, there will be projecting portions or corner portions 62 as shown in FIGS. 13 and 15. When, however, the strip is at the lower limit of its tolerance range, the conditions will exist as shown in FIG. 16. In this instance, the corners 63 of the ear extend to, but not beyond, the upstream and downstream edges 40, 42 of the die opening. When the ear in FIG. 16 is severed from the strip along the dotted line shown in FIG. 16, the slug will be pushed into the die opening and into the passageway and will be held in position by virtue of the fact that its edges are against the surfaces of the die opening along the severed short side of the trapezoidal-shaped slug and at the corners 63 as shown in FIG. 16.

It will be apparent from the foregoing description that if the edge trimming punches and dies are designed in accordance with the principles of the invention, the slugs produced during the trimming operation can be controlled and maintained in neat orderly stacks as they are pushed into the die opening, through the die opening, and through the passageways in the die block to the cavity into which the belt is located. The dimensions of the punch and die opening must be carefully determined in the light of the tolerance range of the strip material when the die is designed.

FIGS. 17 and 18 show an alternative embodiment of the invention in which both side edges of the strip material 64 are trimmed and in which a third punch and die combination are provided. FIG. 17 shows a die plate having die openings for producing, in cooperation with punches, flat blanks 90 for electrical terminals. The blanks are separated from each other by openings 92, 94 which extend normally of the side edges of the strip. Several of the punches for producing the flat blanks 90 are indicated at 96-110 but are not described in detail for the reason that the blank itself forms no part of the present invention.

The strip material 64 has raw side edges 66, 68 which are trimmed to produce trimmed edges 70, 72. The strip has a center line 74 and is fed by a distance 3*p* where p is the pitch of the strip. The pitch and the feed length are indicated by numerals 1, 2, 3 which are repeated along both side edges. The embodiment of FIG. 17 has first and second die openings 84, 86 as described above and in addition has a third die opening 88 which is between the first and second die openings. The punches (not shown) which enter the first and third die openings 84, 86 are as described above. The punch which enters the third die opening 88 has an upstream punch edge which is a shearing edge and a downstream laterally extending edge which is a non-shearing edge of the type provided on the downstream end of the second punch. In this embodiment, the slug 78 produced by the punch which enters the die opening 84 is in the form of a trapezoid. The slug 82 which is produced by the punch which cooperates with and enters the third die opening 88 is in the form of a parallelogram and the punch which enters the die opening 86 produces a slug 80 in the form of a trapezoid as described with reference to the previous embodiment. FIG. 18 shows the progression of one side of the strip. The trimmed edge 70 extends to a trapezoidal ear 80' which is next to a notch 81. The raw edge 66 extends in an upstream direction from the notch. During an operating cycle, the trapezoidal ear 80' is removed, a parallelogram-shaped slug is removed as shown at 82', and a trapezoidal slug is punched from the strip as shown at 78'. Advantageously, the punches and dies on the side 68 are offset from those on the side 66 by a distance of p/2.

In the foregoing description of both embodiments, the punches and dies are shown in positions which are as close to each other as they can possibly be. It will be apparent that there might be a greater distance between the first and second punches or between the first, second, and third punches and dies provided the die openings and punches are located such that the projecting ears will be located over die openings during non-feeding intervals so that they can be removed.

The principles of the invention can be used in a conventional stamping and forming machine or in a machine of the type disclosed in the above-identified U.S. Pat. No. 4,497,196. It will be understood that if the invention is used in a stamping and forming machine of that type, the punches will be reciprocable in a horizontal, rather than a vertical, direction as shown in the drawing. The invention is useful in conventional stamping and forming machines where the parts being produced are relatively small and there is insufficient room conveniently to provide a vacuum slug elimination system.

I claim:

1. A punch and die combination for trimming one raw edge of a strip of material thereby to produce a trimmed edge, the strip having a center line, the trimmed edge and the raw edge being parallel to the center line, the trimmed edge being spaced from the center line by a distance d, the raw edge being spaced from the center line by a distance d' where d' is greater than d, the strip being intermittently fed along a strip feed path which extends between the punch and die combination, the punch and die combination comprising:

die plate means having first and second die openings therein, the die openings being on the strip feed path with the first die opening being upstream, relative to the direction of strip feed, from the second die opening, and first and second punches which conform to the first and second die openings respectively and which enter the first and second die openings when the punches and dies move relatively towards and away from each other between open and closed positions, each die opening having a die opening main shearing edge, the die opening main shearing edges being in alignment with each other and extending parallel to the strip feed path, the die opening main shearing edges being between the raw edge and the center line of the strip and spaced from the center line by the distance d, each die opening has a die opening upstream shearing edge and a die opening downstream shearing edge, the upstream shearing edge of each die opening extending from the upstream end of the associated die opening main shearing edge laterally outwardly and being inclined in a downstream direction, the downstream shearing edge extending from the downstream end of the associated die opening main shearing edge laterally outwardly and being inclined in an upstream direction, the upstream and downstream die opening shearing edges extending beyond the raw edge of the strip, each of the punches has a punch main shearing edge which is opposed to, and cooperable with, the associated die opening main shearing edge, the first punch has upstream and downstream punch shearing edges extending from the upstream and downstream ends of the first punch main shearing edge, the upstream and downstream punch shearing edges being opposed to, and cooperable with, the upstream and downstream die opening shearing edges of the first die opening, the second punch having upstream and downstream rounded non-shearing edges extending from the upstream and downstream ends of the second punch main shearing edge which are opposed to the upstream and downstream shearing edges of the second die opening whereby, during intermittent feeding of the strip material along the strip feed path and movement of the punch and die combination relatively towards and away from each other during non-feeding intervals, spaced apart notches will be punched from the raw edge by the first punch and first die opening, and the material between the notches will be removed by the second punch and second die opening, and any portions of the strip material which extend beyond the upstream and downstream shearing edges of the second die opening will be pulled into the second die opening by the rounded edges of the second punch, and the slugs produced will be trapezoidal and will be stacked in the second die opening.

2. A punch and die combination as set forth in claim 1 characterized in that a third die opening and a third punch are provided, the third punch and third die opening being between the first punch and first die opening and the second punch and second die opening, the third die opening being substantially identical to the first and second die openings, the third punch having a punch main shearing edge and an upstream laterally extending shearing edge which is identical to the upstream laterally extending shearing edge of the first punch, the third punch having a rounded non-shearing downstream edge which extends outwardly and is inclined in an upstream direction whereby the slug punched from the strip by the third punch will be in the shape of a parallelogram, and any portions of the slug which extend beyond the downstream shearing edge of the third die opening will be pulled into the third die opening and stacked in the third die opening.

3. A punch and die combination as set forth in claim 1 characterized in that the strip material is fed along the feed path during each feeding cycle by a distance 2*p* and the strip has a pitch p, and the second punch and die opening are spaced from the first punch and die opening by a distance of at least 3*p*.

4. A punch and die combination as set forth in claim 3 characterized in that each of the die openings and each punch has a trapezoidal cross-section comprising a long side, a short side and ends, the long sides being the main shearing edges, the ends being the upstream and downstream edges of each die opening and each punch.

5. A punch and die combination as set forth in claim 2 characterized in that the strip is fed along the feed path during each feeding cycle by a distance 3*p* and the strip has a pitch p, the third punch and die opening being spaced from the first punch and die opening by a distance of at least 2*p*, and the second punch and die opening being spaced from the third punch and die opening by a distance of at least 2*p*.

6. A punch and die combination as set forth in claim 5 characterized in that each of the punches and each of the die openings has a trapezoidal cross-section comprising a long side, a short side, and ends, the long side being the main shearing edge, the ends being the upstream and downstream edges of each punch and die opening.

7. A punch and die combination as set forth in claim 6 characterized in that a punch and die combination is provided for trimming both of the raw edges of the strip, the punches and dies which trim the one raw edge being offset from the corresponding punches and die which trim the other raw edge by a distance equal to p/2.

8. A punch and die combination for trimming a raw edge of a strip of material to produce a trimmed edge, the strip having a center line, the trimmed edge extending parallel to the center line and being spaced from the center line by a distance d, the raw edge being spaced from the center line by a distance d' where d' is greater than d, the strip of material being intermittently fed along a strip feed path which extends between the punch and die, the punch and die being characterized in that:

the die comprises a die opening which extends into a die plate, the die opening having a die opening main shearing edge having an upstream end and a downstream end relative to the direction of strip feed, the die opening main shearing edge being spaced from the center line by the distance d, an upstream laterally extending die opening shearing edge and a downstream laterally extending die opening shearing edge, the upstream edge extending laterally away from the upstream end of the die opening main shearing edge and being inclined in a downstream direction, the downstream edge extending laterally away from the downstream end of the main shearing edge and being inclined in an upstream direction, both the upstream and downstream die opening edges extending laterally beyond the raw edge, the punch having a punch main shearing edge which is opposed to, in alignment with, and complementary to the die opening main shearing edge, the punch having upstream and downstream laterally extending punch edges which are opposed to, and movable past, the upstream and downstream die opening shearing edges, at least one of the laterally extending punch edges being a rounded non-shearing edge whereby, upon movement of the punch into the die opening, the main shearing edges of the punch and die will shear the strip along a shear line spaced from the center line by the distance d, and any portion of the strip which extends beyond the die opening and beyond the rounded non-shearing edge of the punch will be pulled into the die opening by the rounded non-shearing edge on the punch and the slugs produced will be stacked in an orderly stack in the die opening.

9. A punch and die combination as set forth in claim 8 characterized in that the upstream and downstream laterally extending punch edges are both rounded non-shearing edges whereby any portions of the strip which extend beyond the upstream and downstream edges of the die opening will be pulled into the die opening and the slugs produced during continuous operation will be stacked in the die opening.

* * * * *